US009656118B2

(12) United States Patent
Campanaro et al.

(10) Patent No.: US 9,656,118 B2
(45) Date of Patent: May 23, 2017

(54) EXERCISE DEVICE AND METHOD OF USING SAME

(71) Applicant: Total Gym Global Corp., San Diego, CA (US)

(72) Inventors: Thomas J. Campanaro, Rancho Santa Fe, CA (US); Jesse Thomas Campanaro, San Diego, CA (US); Dan McCutcheon, San Diego, CA (US)

(73) Assignee: Total Gym Global Corp., San Diego, CA (US)

( * ) Notice: Subject to any disclaimer, the term of this patent is extended or adjusted under 35 U.S.C. 154(b) by 23 days.

(21) Appl. No.: 14/823,710

(22) Filed: Aug. 11, 2015

(65) Prior Publication Data

US 2016/0107024 A1 Apr. 21, 2016

Related U.S. Application Data

(60) Provisional application No. 62/066,721, filed on Oct. 21, 2014.

(51) Int. Cl.

| | |
|---|---|
| ***A63B 21/00*** | (2006.01) |
| ***A63B 22/20*** | (2006.01) |
| ***A63B 21/055*** | (2006.01) |
| ***A63B 22/00*** | (2006.01) |
| ***A63B 23/04*** | (2006.01) |
| ***A63B 21/02*** | (2006.01) |

(52) U.S. Cl.

CPC ..... *A63B 22/205* (2013.01); *A63B 21/00069* (2013.01); *A63B 21/022* (2015.10); *A63B 21/0552* (2013.01); *A63B 21/4031* (2015.10); *A63B 21/4045* (2015.10); *A63B 22/0089* (2013.01); *A63B 23/04* (2013.01); *A63B 2023/0411* (2013.01); *A63B 2225/09* (2013.01)

(58) Field of Classification Search

CPC ..... A63B 21/00
USPC ..... 482/142, 130, 121
See application file for complete search history.

(56) References Cited

U.S. PATENT DOCUMENTS

| | | | |
|---|---|---|---|
| D251,079 | S | 2/1979 | Shugarman |
| D284,597 | S | 7/1986 | Smith |
| 5,263,913 | A | 11/1993 | Boren |

(Continued)

OTHER PUBLICATIONS

First office action for Chinese patent application No. 201530107844.1 mailed on Jul. 17, 2017 in 1 page.

(Continued)

*Primary Examiner* — Jerome w Donnelly
(74) *Attorney, Agent, or Firm* — Procopio Cory Hargreaves and Savitch LLP

(57) ABSTRACT

An inclinable exercise device includes a support; an adjustable incline having an upper portion and a lower portion, the upper portion operably supported by the support to allow adjustment in an angle of the adjustable incline; a user support platform movably attached to the adjustable incline for movement of the user support platform along the adjustable incline during at least one of jumping and squat exercises; a foot support stand secured to the adjustable incline in the lower portion, the foot support engaged by one's feet during at least one of jumping and squat exercises; one or more resistance mechanisms resisting upward movement of the user support platform along the adjustable incline during at least one of jumping and squat exercises.

11 Claims, 14 Drawing Sheets

(56) References Cited

U.S. PATENT DOCUMENTS

| | | | |
|---|---|---|---|
| D362,700 | S | 9/1995 | Breibart et al. |
| D382,319 | S | 8/1997 | Gerschefske et al. |
| D405,132 | S | 2/1999 | Westfall et al. |
| 6,120,425 | A | 9/2000 | Endelman |
| D431,615 | S | 10/2000 | Webber et al. |
| D438,918 | S | 3/2001 | Batca et al. |
| 6,371,895 | B1 | 4/2002 | Endelman et al. |
| D481,428 | S | 10/2003 | Giannelli et al. |
| D493,853 | S | 8/2004 | Campanaro et al. |
| 7,270,628 | B2 | 9/2007 | Campanaro et al. |
| D556,274 | S | 11/2007 | Morgan |
| 7,537,552 | B2 | 5/2009 | Dalebout et al. |
| D608,401 | S | 1/2010 | Campanaro et al. |
| D612,000 | S | 3/2010 | Campanaro et al. |
| D635,205 | S | 3/2011 | Thulin |
| 8,033,971 | B2 | 10/2011 | Campanaro et al. |
| 8,075,457 | B2 | 12/2011 | Campanaro et al. |
| D659,205 | S | 5/2012 | Endelman et al. |
| 8,323,157 | B2 | 12/2012 | Campanaro et al. |
| D694,347 | S | 11/2013 | Campanaro et al. |
| D703,279 | S | 4/2014 | Ho |
| 8,702,575 | B2 | 4/2014 | McVay et al. |
| D726,263 | S | 4/2015 | Anderson |
| 2001/0056011 | A1 | 12/2001 | Endelman et al. |
| 2003/0195095 | A1* | 10/2003 | Endelman ..... A63B 21/023 482/142 |
| 2006/0019806 | A1 | 1/2006 | Mikulski |
| 2007/0049470 | A1 | 3/2007 | Pyles et al. |
| 2009/0163323 | A1 | 6/2009 | Bocchicchio |
| 2010/0227748 | A1 | 9/2010 | Campanaro et al. |
| 2012/0053028 | A1 | 3/2012 | Campanaro et al. |
| 2014/0141948 | A1 | 5/2014 | Aronson et al. |
| 2014/0194260 | A1 | 7/2014 | Campanaro et al. |

OTHER PUBLICATIONS

International Search Report and Written Opinion for International patent application No. PCT/US2015/054975 mailed on Feb. 5, 2016 in 11 pages.

* cited by examiner

EXERCISE DEVICE AND METHOD OF USING SAME

CROSS-REFERENCE TO RELATED APPLICATION

This application claims priority to U.S. Provisional Patent Application No. 62/066,721 filed on Oct. 21, 2014, which is incorporated by reference herein.

FIELD OF THE INVENTION

The present invention relates to jump and/or squat exercise devices.

SUMMARY OF THE INVENTION

An aspect of the invention involves an inclinable exercise device for use during at least one of jumping and squat exercises. The inclinable exercise device includes a support; an adjustable incline having an upper portion and a lower portion, the upper portion operably supported by the support to allow adjustment in an angle of the adjustable incline; a user support platform movably attached to the adjustable incline for movement of the user support platform along the adjustable incline during at least one of jumping and squat exercises; a foot support stand secured to the adjustable incline in the lower portion, the foot support engaged by one's feet during at least one of jumping and squat exercises; one or more resistance mechanisms resisting upward movement of the user support platform along the adjustable incline during at least one of jumping and squat exercises.

One or more implementations of the aspect of the invention described immediately above includes one or more of the following: the one or more resistance mechanisms include a variable resistance mechanism to allow adjustment in resistance in the variable resistance mechanism; the variable resistance mechanism includes more than one elastic member selectively coupleable between the user support platform and the adjustable incline to allow adjustment in resistance in the variable resistance mechanism; the one or more resistance mechanisms include a braking resistance mechanism to decelerate upward motion of the user support platform along the adjustable incline; the braking resistance mechanism is a gas strut brake; the adjustable incline includes a downward travel limiting mechanism that limits the maximum downward distance that the user support platform can travel; the downward travel limiting mechanism is an adjustable knee flexion limiter and the adjustable incline includes more than one hole that the knee flexion limiter is receivable within to adjust the maximum downward distance that the user support platform can travel; the foot support stand includes an engagement surface that is continuously curved, keeping one's feet engaged therewith substantially perpendicular to one's lower legs during use; a plurality of rollers that the user support platform rolls along the adjustable incline on, the rollers each including a nylon rim with a plurality of spokes surrounded by a polyurethane tire that locks around the spokes; the support includes a base with a suspension wheel assembly having opposing suspension wheels and respective spring assemblies urging the suspension wheels downwardly relative to the base; the support includes a cross bar coupling the opposing suspension wheels together so as to translate force on one of the suspension wheels to the opposing suspension wheel so that the suspension wheels go up and down in unison; the spring assemblies include spring coefficients that cause the opposing suspension wheels to retract up into the base strut when one is on the exercise device so that the exercise device and deploy downward when one is not on the exercise device.

DETAILED DESCRIPTION OF PREFERRED EMBODIMENTS

Figure 1:
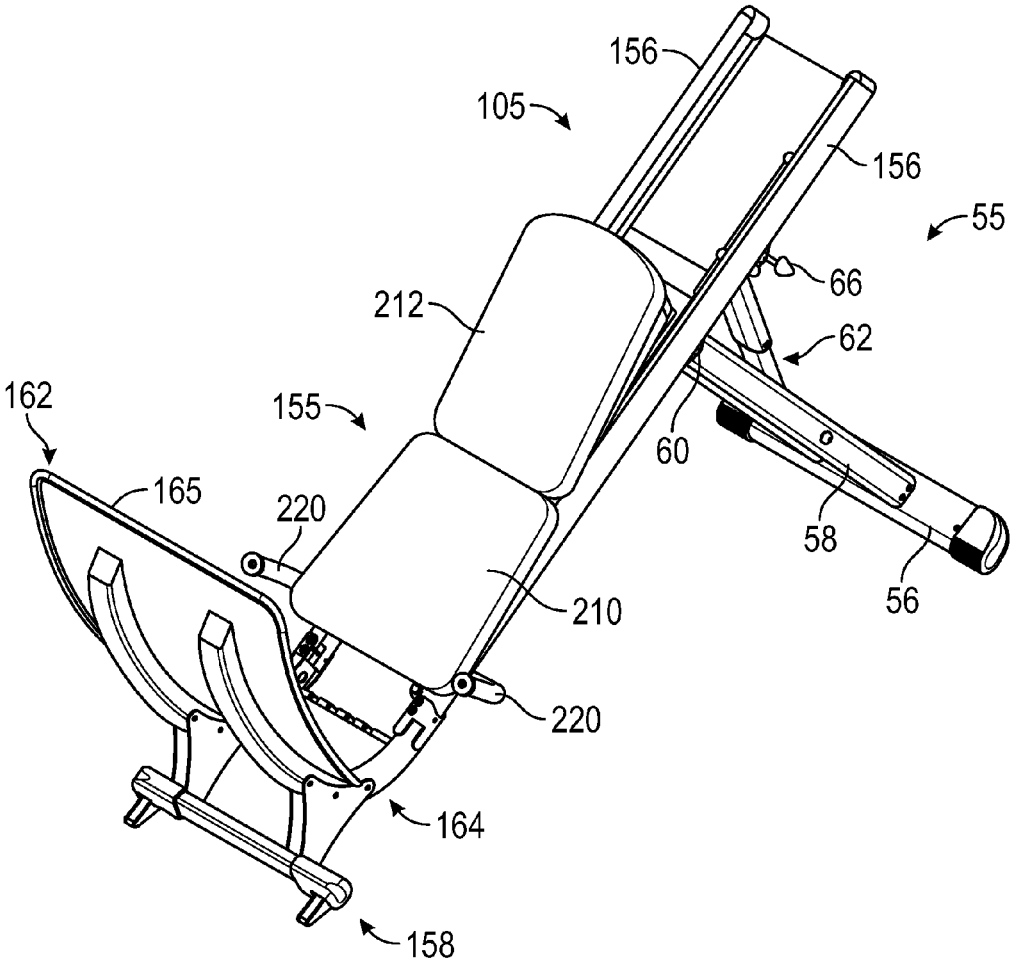
FIG. 1 is a front perspective view of an embodiment of a jumping exercise device.
Figure 2:
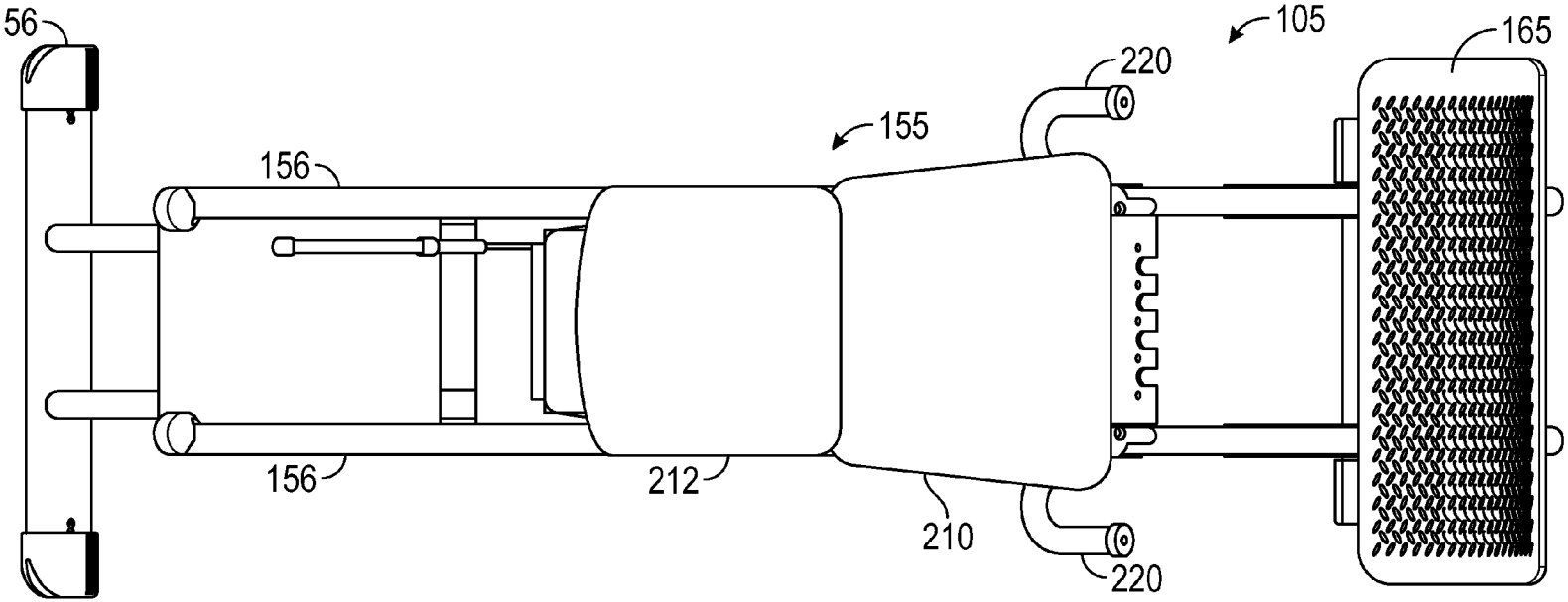
FIG. 2 is a top plan view of the jumping exercise device of FIG. 1.
Figure 3:
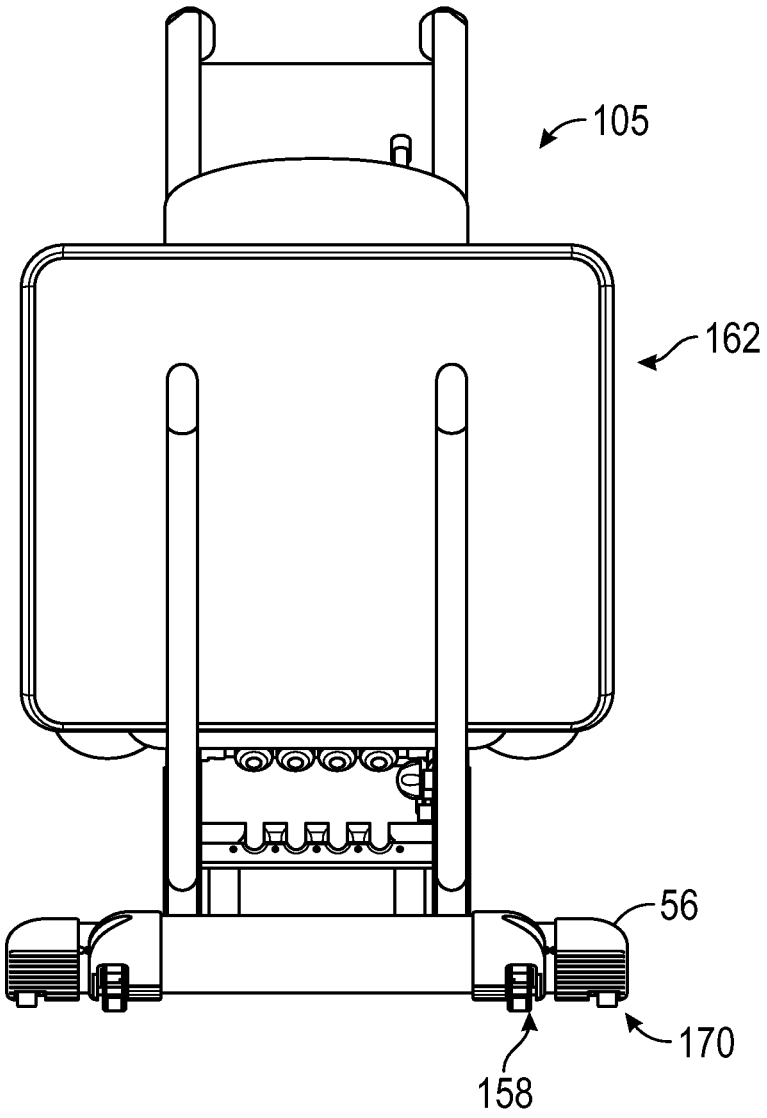
FIG. 3 is a front elevation view of the jumping exercise device of FIG. 1.
Figure 4:
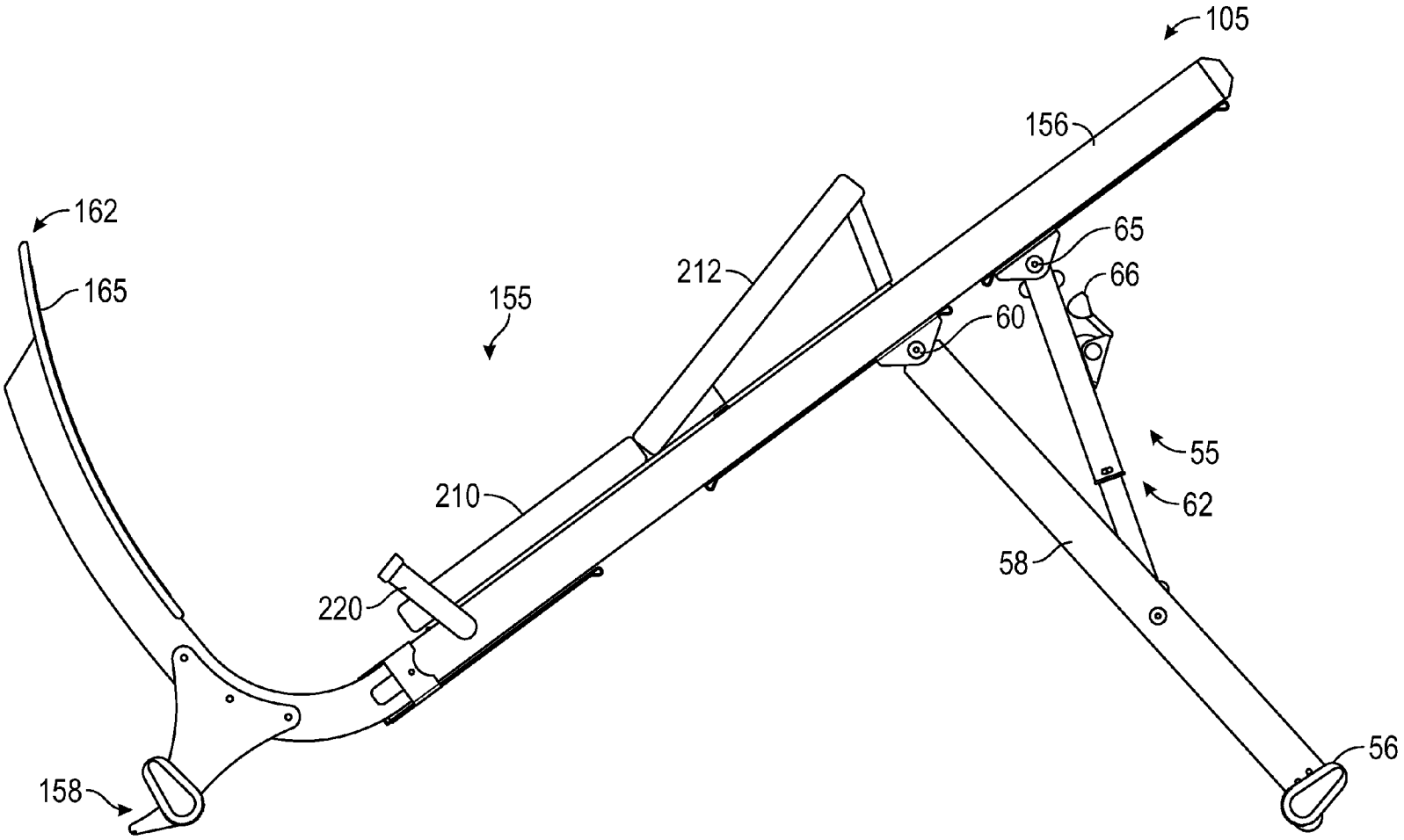
FIG. 4 is a right side elevation view of the jumping exercise device of FIG. 1.

With reference initially to FIGS. 1-7, an embodiment of a jumping exercise device 105 will be described. Although the device 105 will be described in connection with jumping and exercise, in alternative embodiments, the device 105 may be used in conjunction with squat exercises or other exercises, and/or may be used for physical therapy or other purposes.

The jumping exercise device 105 comprises a sliding user support platform or glide board 155 slidably mounted on adjustable incline or inclined rails 156 which are secured to a cross bar 158 at their lower ends of a lower portion of the adjustable incline 156 and are supported in an inclined orientation at a selected inclination angle by an adjustable support assembly or support 55 at an upper portion of the adjustable incline.

The adjustable support assembly 55 will be described in more detail. The inclination angle is adjusted so that the rails 156 extend at a desired inclination angle to provide a desired resistance. Adjustable support assembly 55 supports the rails 156 at a selected inclination angle. Assembly 55 comprises a base or base strut 56, a pair of struts 58 extending at an angle from base strut 56 and pivotally secured to the respective rails 156 at their upper ends via pivots 60, and a telescopically adjustable strut assembly 62 extending between cross bar 63 which extends between lower portions of struts 58 and a cross bar 64 at its upper end which is pivotally connected to the rails 156 at their upper ends via pivots 65. A spring loaded locking pin or pawl 157 actuated by handle or lever 66 extends through aligned openings 159 in telescoping portions 62A and 62B of arm 62 to control the inclination angle. A user can simply actuate handle 66 to release the locking pin 157 from the telescoping portions of the arm, and then adjust the length of arm 62 up or down using the same handle before releasing it to lock the arm at the adjusted length when the desired inclination angle is reached.

With reference additionally to FIGS. 15A-16C, the base strut 56 includes a suspension wheel assembly 170 including opposing suspension wheels 172, 174 coupled by a cross bar 176. The suspension wheels 172, 174 are urged downwardly relative to the base strut 56 by respective spring assemblies 176, 178. The cross bar 176 translates forces on one of the suspension wheels 172, 174 to the other suspension wheel 172, 174 so that the wheels go up and down in unison. The respective spring assemblies 176, 178 include spring coefficients that cause the wheels 172, 174 to retract up into the base strut 56 when a user is on the exercise device 105 so that the exercise device does not accidentally move during use, but deploy downward when the user is not on the exercise device 105 and the exercise device 105 is tilted at an angle so that the exercise device 105 can be easily rolled to a new location. The spring assemblies are designed to not fully lift the base 56 when the user gets off so that motion will not be noticed by the user. However the wheels lift 90% of the load of the base 56 off the floor to allow easy motion while changing the incline linkage 55. When the wheels 172, 174 are deployed, a user can slide or roll the exercise device 105 across a room by lifting up on the opposite side of the exercise device 105 and pulling or pushing the exercise device 105 to cause the exercise device 105 to roll around the room.

With reference additionally to FIGS. 14A-14E, a foot support stand or squat stand 162 is secured to the rails 156 adjacent their lower ends via a support frame connection assembly 180. The squat stand 162 has a support frame 164 which curves upwards away from rails 156 for coupling curved support pad or plate 165 (for engagement by the user's feet when performing jumping/squat exercises) to the rails 156. The cross bar 158 is coupled to the support frame 164 via brackets 182. Laterally traversing the support frame connection assembly 180 is a lower bungee rack 184 including a plurality of U-shaped bungee cord receiving slots for securing one or more bungee cords 186 (FIG. 10) thereto for varying the resistance of the glide board 155 during movement of the glide board 155. Thus, the one or more bungee cords 186 form a variable resistance mechanism during movement of the glide board 155.

Figure 10:
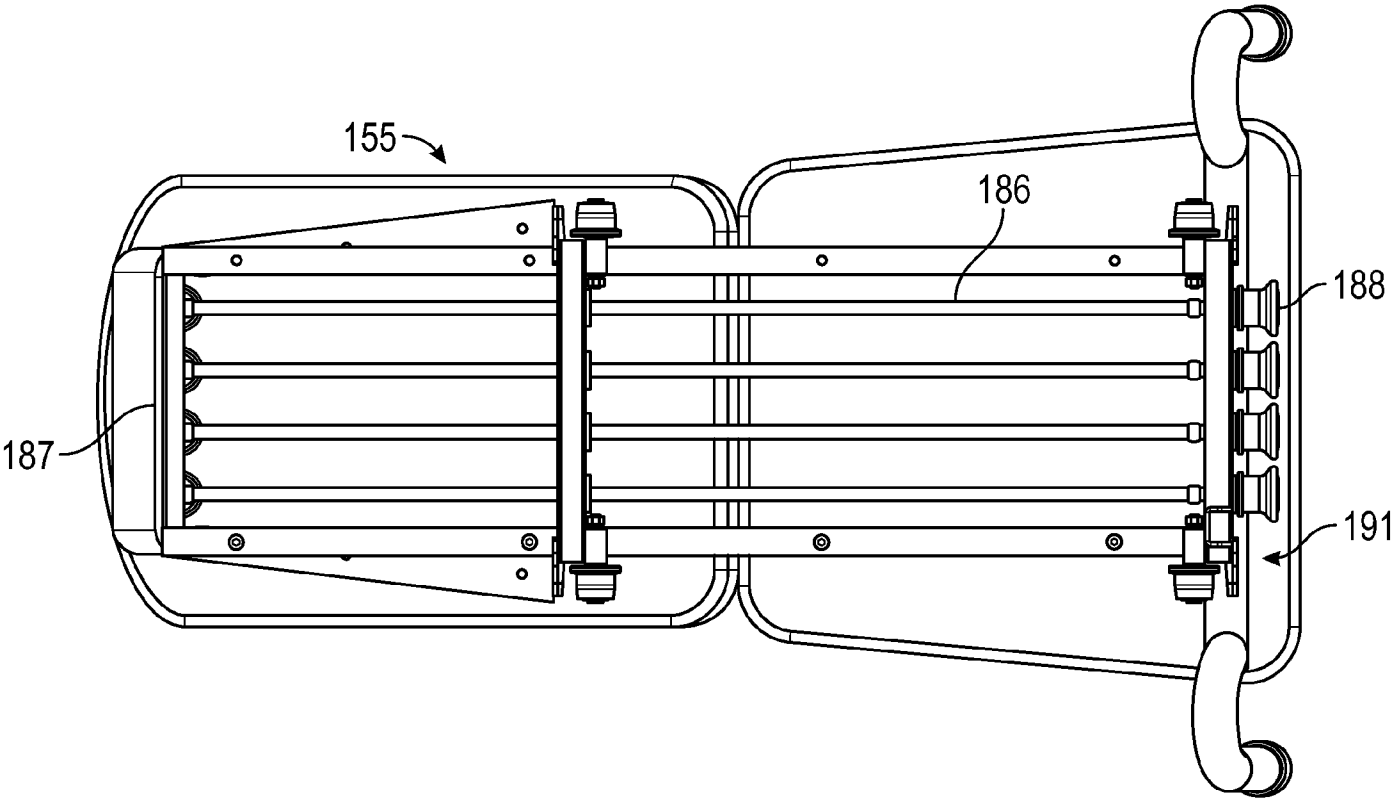
FIG. 10 is a bottom plan view of an embodiment of a glide board of the jumping exercise device of FIG. 1 and shows a jumping variable resistance assembly for the glide board.
Figure 11A:
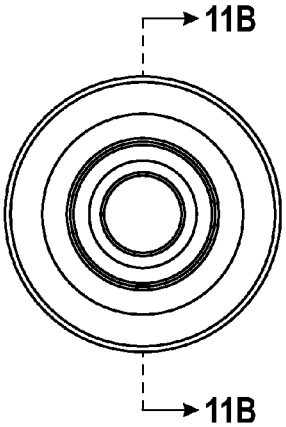
FIGS. 11A, 11B, and 11C are front elevational, cross sectional, and side elevational views of an embodiment of a roller for the glide board.
Figure 11B:
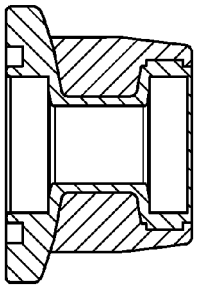
Figure 11C:
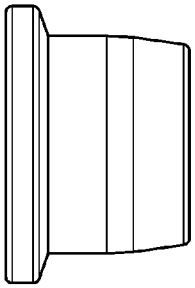
Figure 12A:
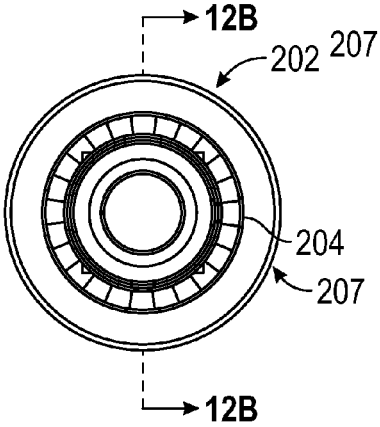
FIGS. 12A, 12B, and 12C are front elevational, cross sectional, and side elevational views of an embodiment of a rim of the roller of FIGS. 11A-11C.
Figure 12B:
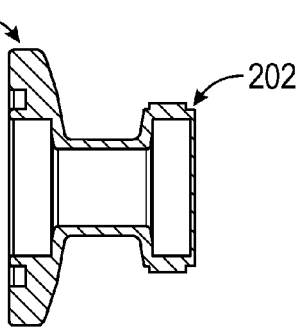
Figure 12C:
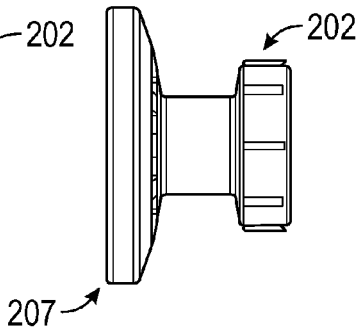
Figure 13A:
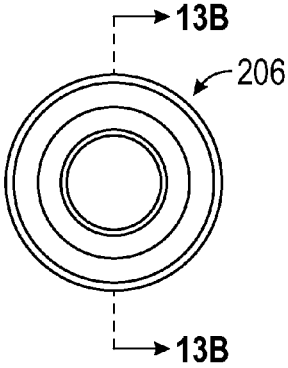
FIGS. 13A, 13B, and 13C are front elevational, cross sectional, and side elevational views of an embodiment of a tire of the roller of FIGS. 11A-11C.
Figure 13B:
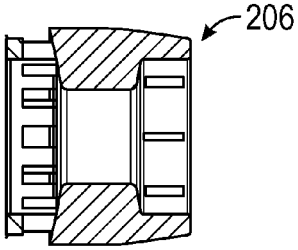
Figure 13C:
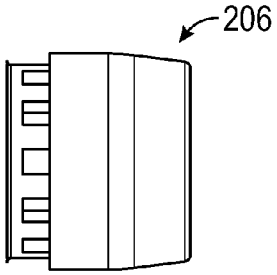
Figure 14C:
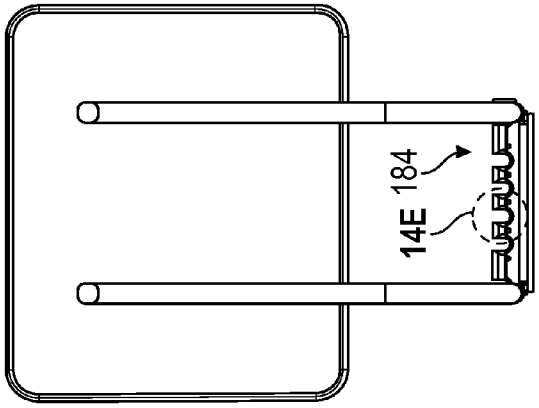
FIGS. 14A, 14B, and 14C are side elevational view, front elevational and rear elevational views of a jumping stand and bungee rack of the jumping exercise device of FIG. 1.
Figure 14B:
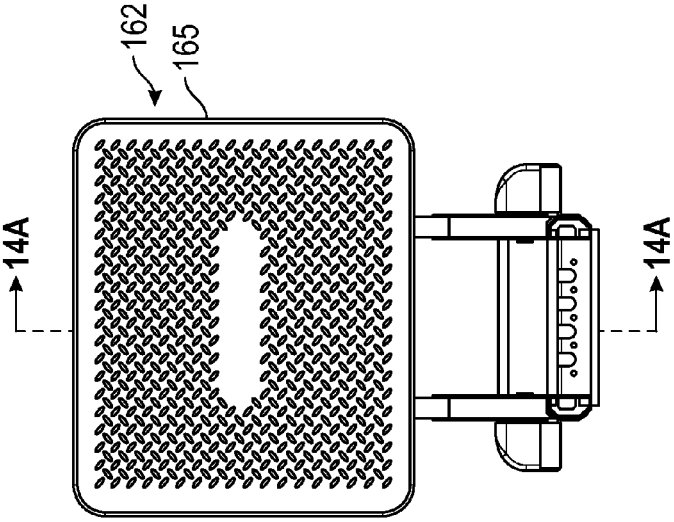
Figure 14A:
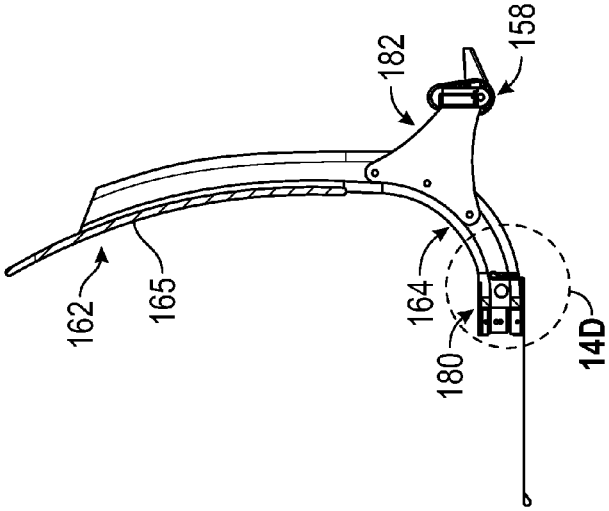
Figure 14D:
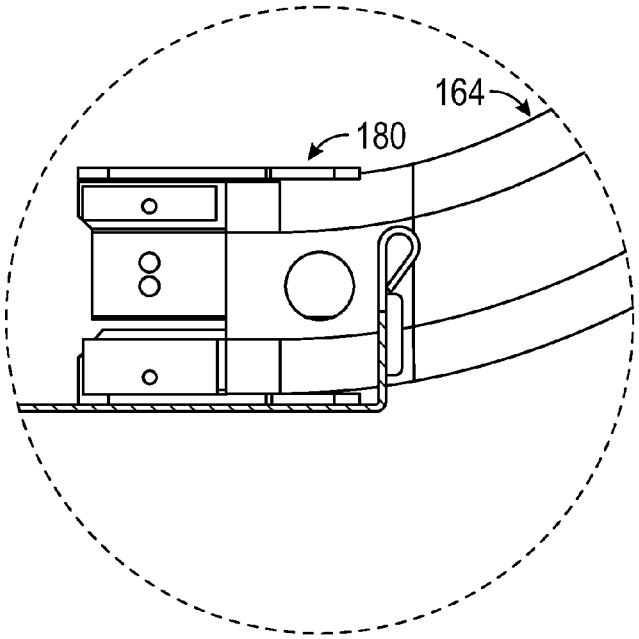
FIG. 14D is an enlarged side elevational view taken along section G of FIG. 14A of a support frame connection assembly of the jumping exercise device of FIG. 1.
Figure 14E:
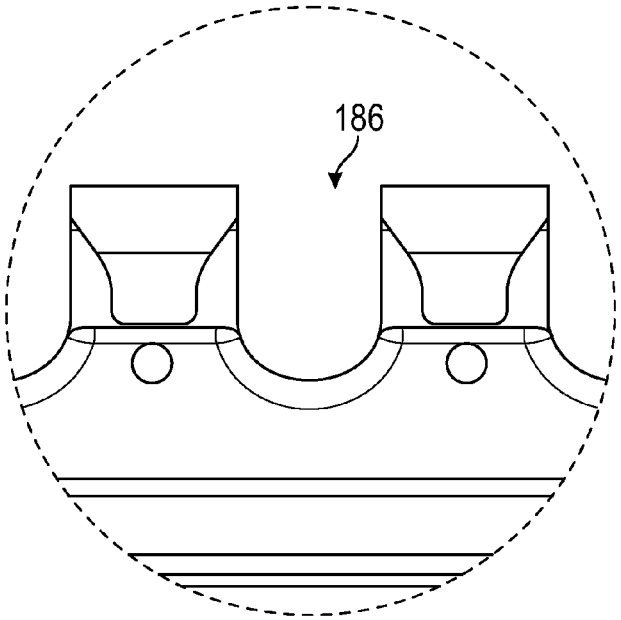
FIG. 14E is an enlarged side rear elevational view taken along section H of FIG. 14E of the bungee rack of the jumping variable resistance assembly.
Figure 15A:
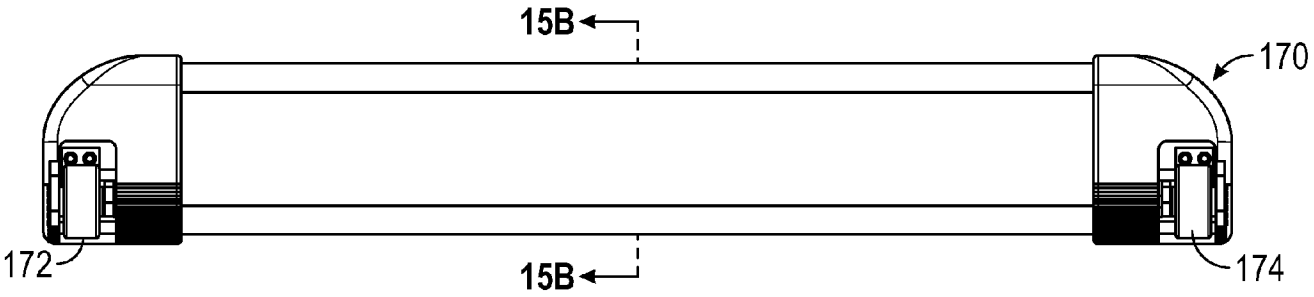
FIG. 15A is a rear elevational view of an embodiment of a suspension wheel assembly of the jumping exercise device of FIG. 1.
Figure 15B:
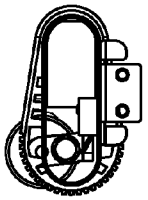
FIG. 15B is a cross-sectional view taken along line I-I of the suspension wheel assembly of FIG. 15A.
Figure 15C:
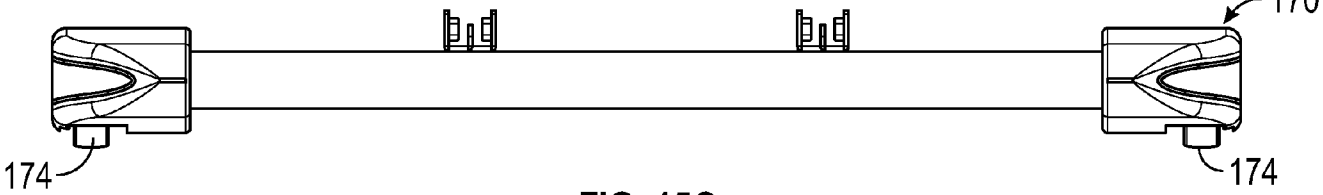
FIG. 15C is a top plan view of the suspension wheel assembly of FIG. 15A.
Figure 16A:
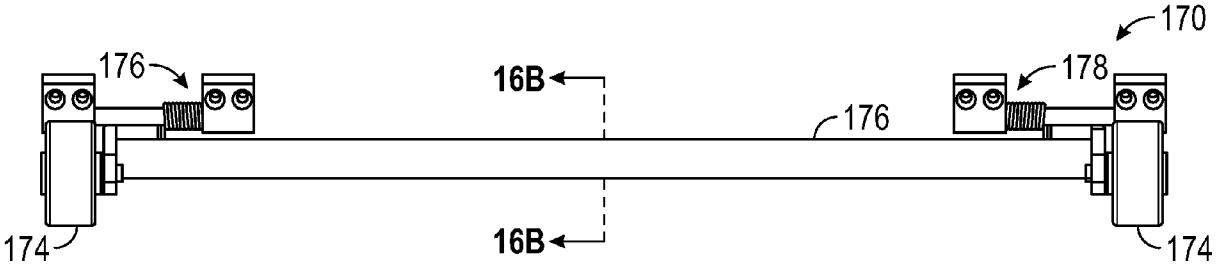
FIG. 16A is a rear elevational view of opposing suspension wheels and cross bar of the suspension wheel assembly of FIGS. 15A-15C.
Figure 16B:
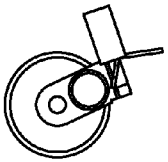
FIG. 16B is a cross-sectional view taken along line J-J of the opposing suspension wheels and cross bar of FIG. 16A.
Figure 16C:
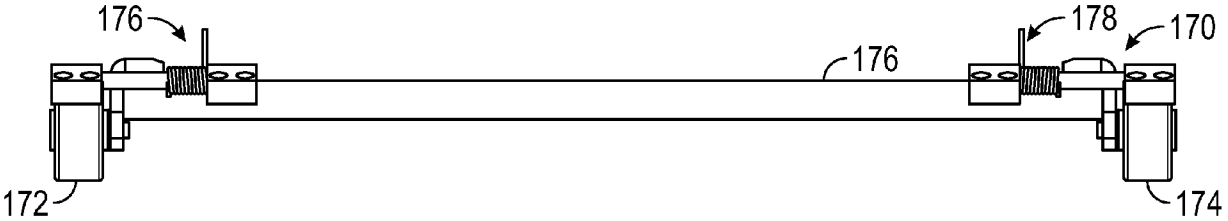
FIG. 16C is a top plan view of the opposing suspension wheels and cross bar of FIG. 16A.

As shown in FIG. 10, along an underside of the glide board 155, a plurality of bungee cords and/or hoses 186 are disposed. In alternative embodiments, other types of elastic devices may be used other than bungee cords. The invention is not restricted to any type of elastic device or the illustrated architectures or configurations shown and/or described herein. A first glide board bungee rack 187 includes a plurality of D-ring anchors that receive hooks on first distal ends of the bungee cords 186. The D-ring anchors make it easy for a gym operator to remove and/or replace the bungee cords 186 without a special tool. At opposite second distal ends of the bungee cords and/or hoses 186, pull knobs/flanges 188 are disposed. To vary the jumping resistance of the glide board 155, a user may pull downward on one or more of the pull knobs 188 and secure them via the flanges to the lower bungee rack 184. The greater the number of bungee cords 186 coupled to the lower bungee rack 184, the greater the jumping resistance and vice versa. Thus, the bungee cords 186 (along with the racks) form a jumping variable resistance assembly. The bungee cords 186 enable one to progressively increase resistance to challenge even the most advanced athletes with a small floor space.

Figure 8:
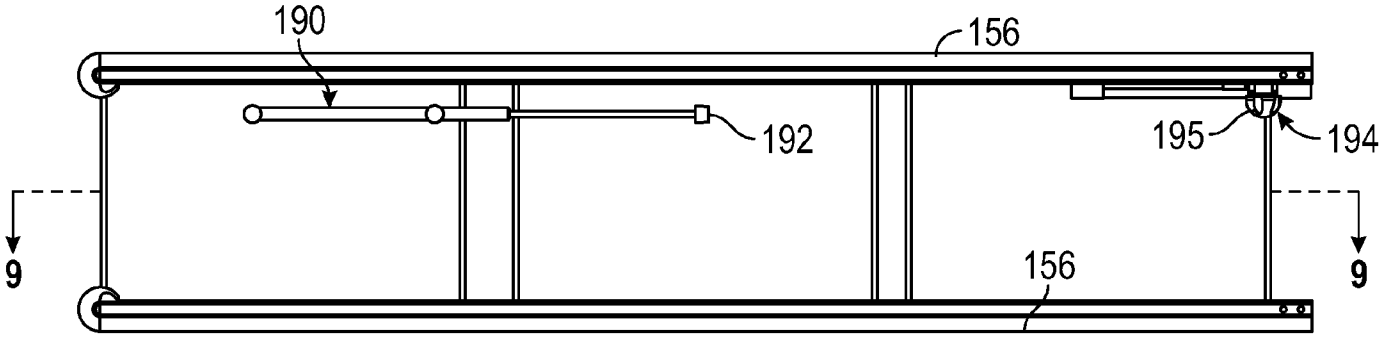
FIG. 8 is a top plan view of an embodiment of a rail assembly of the jumping exercise device of FIG. 1 and shows an embodiment of a gas strut brake and an embodiment of a glide board knee flexion limiter.
Figure 9:
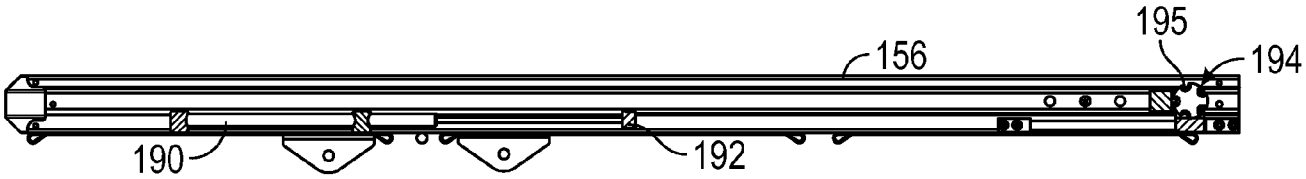
FIG. 9 is a cross-sectional view taken along line A-A of FIG. 8 of the rail assembly, and shows the gas strut brake and the glide board knee flexion limiter.

With reference to FIGS. 8 and 9, a gas strut brake 190 is disposed along the underside and adjacent one side of the glide board 155. A rubber bumper 192 attached to the gas strut 190 impacts metal bracket 191, and together, provide a resistance mechanism to decelerate the jump up and disengages by dampening within the strut on return down with the glide board 155. This softens the impact on the knees and all other joints of the user from the landing due to reduced height of the jump (less time to accelerate down) on return of each jump on the curved support plate 165 by the user. The gas strut brake 190 does not brake at shorter distances, preventing braking, for example, when performing squats. The gas strut brake 190 is designed to only engage when tall athletes are airborne An adjustable glide board knee flexion limiter 194 forms a downward travel limiting mechanism that limits the maximum downward distance that the glide board 155 can travel. The location of the glide board knee flexion limiter 194 may be varied along the rail 156 to adjust the maximum downward distance that the glide board 155 can travel. The adjustable glide board knee flexion limiter 194 includes a spring-loaded knob that unscrews from and screws into a variety of differently spaced holes.

With reference to FIGS. 11A-13C, an embodiment of a roller 200, which is one of a plurality of rollers 200 that the glide board 155 rolls along the guide rails 156 on, will be described. The roller 200 includes a nylon rim 202 with a plurality of spokes 204 surrounded by a polyurethane tire 206. The polyurethane tire 206 is cast and locks around the spokes 204 in the nylon rim 202. Polyurethane, which is an excellent outer material for the rollers 200, will not bond to nylon. In the past, polyurethane surrounded costly aluminum rims. The spokes 204 inside of flange 207 of the nylon rim 202 allow the polyurethane tire 206 to be cast around the spokes 204 so that polyurethane material can be secured to the inexpensive nylon rim 202.

Figure 5:
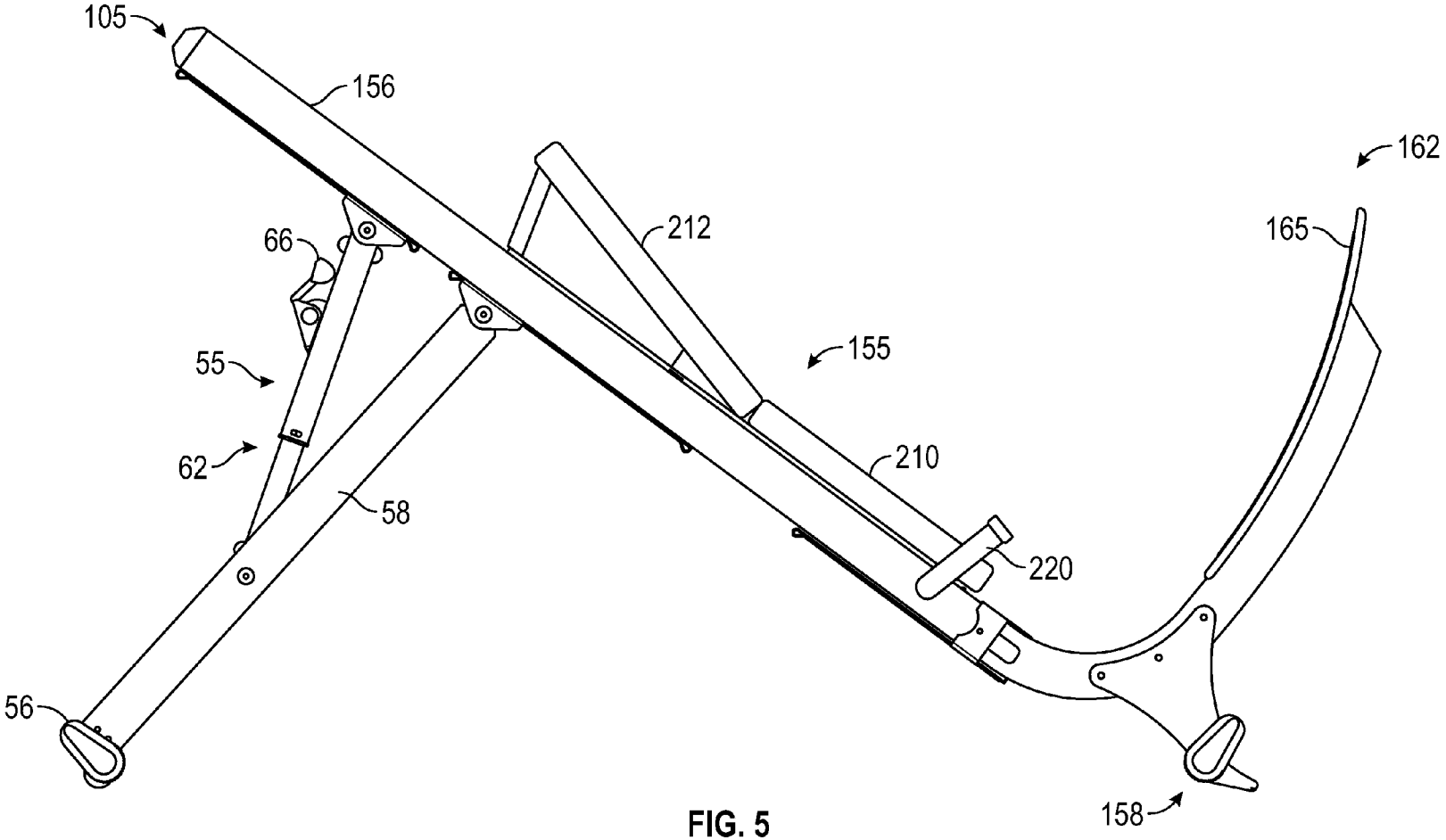
FIG. 5 is a left side elevation view of the jumping exercise device of FIG. 1.
Figure 6:
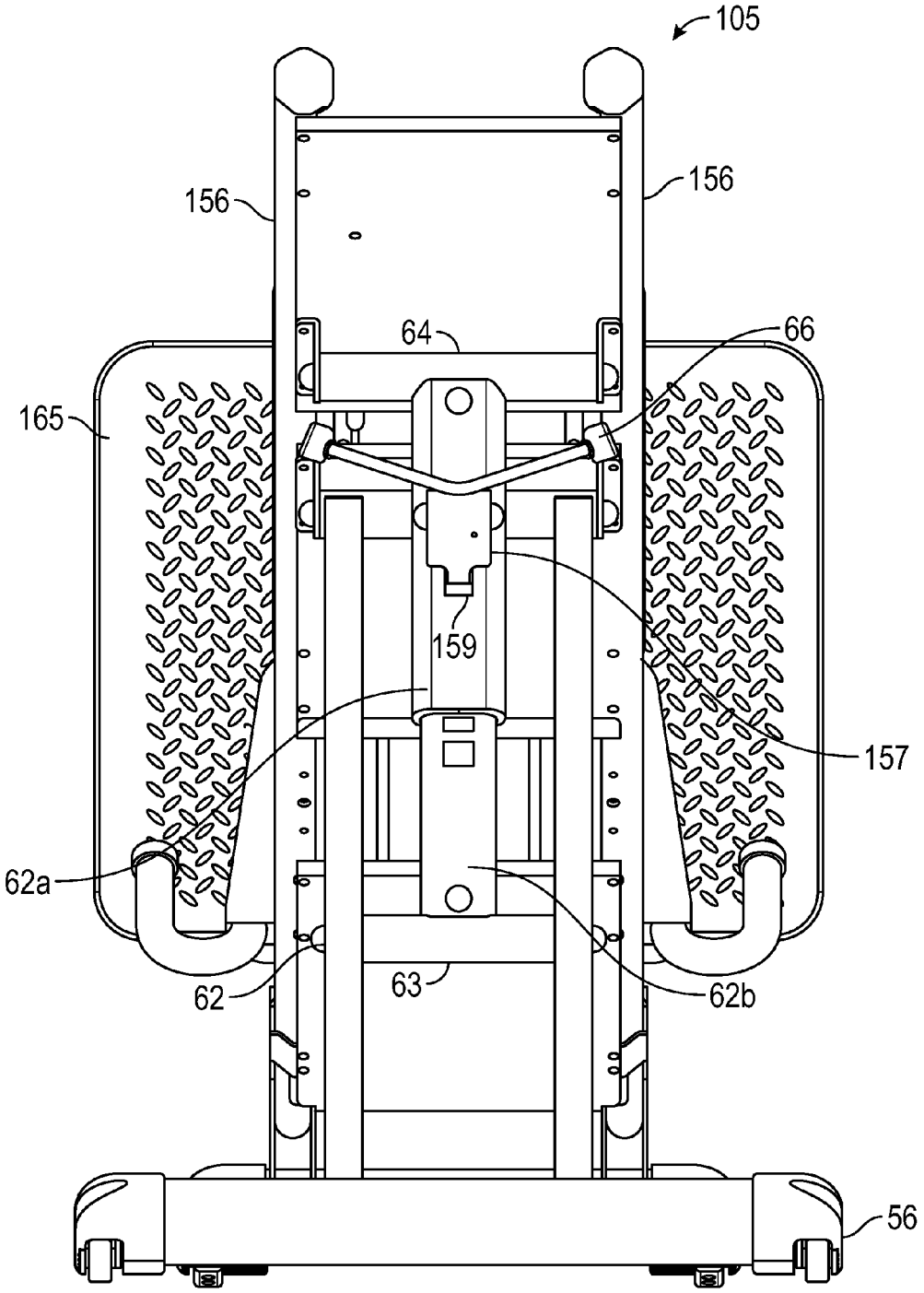
FIG. 6 is a rear elevation view of the jumping exercise device of FIG. 1.
Figure 7:
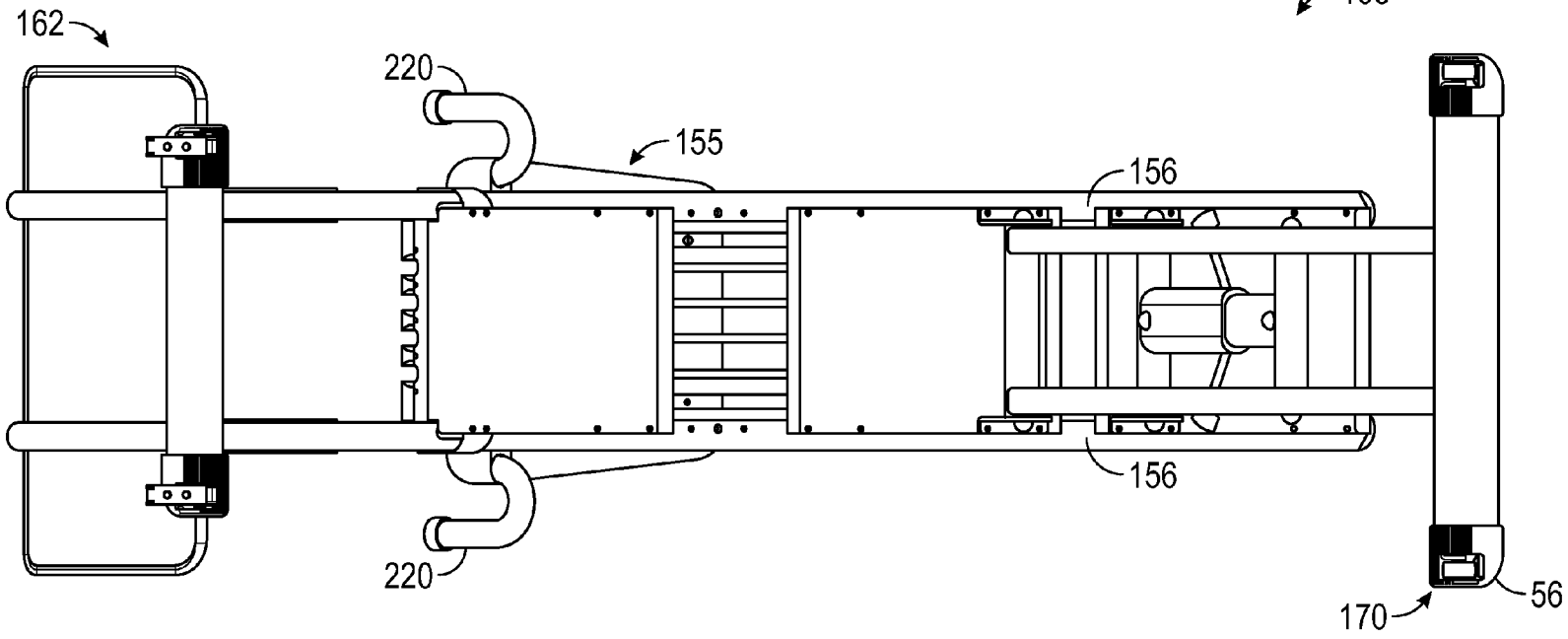
FIG. 7 is a bottom plan view of the jumping exercise device of FIG. 1.

With reference to FIG. 5, the glide board 155 includes a lower flat cushion section 210 and an upper angled upper cushion section 212 that is angled so that a user's head lying on the upper angled upper cushion section 212 faces towards the curved foot plate 165.

Along opposite sides of the glide board 155 are user handles 220.

The jumping exercise device 105 will now be described in use. With the rails 156 at an incline, a user lies with one's back on the glide board 155 with one's head resting on the upper angled upper cushion section 212 so that a user faces towards the curved foot plate 165 (shoulders are at the location where the upper surfaces of the lower flat cushion section 210 and the upper angled upper cushion section 212 intersect and the user's rear is just above the bottom of the lower flat cushion section 210). To vary the jumping resistance of the glide board 155, a user may vary the angle of the jumping exercise device 105 with the adjustable support assembly 55 and/or via the bungee cord(s) 186 (preferably the jumping resistance is varied by only varying the angle of the jumping exercise device 105). To vary the jumping resistance of the glide board 155, a user may pull downward on one or more of the pull knobs 188 and secure them to the lower bungee rack 184. The greater the number of bungee cords 186 coupled to the lower bungee rack 184, the greater the jumping resistance and vice versa. As the user and the glide board 155 travel upwards upon jumping, the gas strut brake 190 causes the glide board 155 to decelerate the glide board 155, reducing the distance traveled toward the end of the rails and enabling the length of the guide rails 156, and, hence, the jumping exercise device 105, to be smaller/shorter. The deceleration also reduces the height so landing acceleration is reduced, which unique to this machine, softens the impact on the lower body joints of the user from the landing on return of the jump on the curved support plate 165 by the user. The adjustable glide board knee flexion limiter 194 also limits the maximum downward distance that the glide board 155 can travel. The continuous or perfect curved nature of an upper/engagement surface of the support plate 165 on the inclined jumping exercise device 105 keeps the user's feet thereon substantially perpendicular to the user's lower legs where strength is greatest, for confidence, for comfort, and safety from slipping.

A user may also perform squat exercises or other exercises/therapies with the exercise device 105 such as, but not limited to, a standard squat movement at an incline with the user's back on the moving glide board 155. The squat exercise starts with the glide board 155 in a raised position and the user's feet engaging the foot plate 165. The user then lowers the glide board 155 until their knees and hips are bent at around ninety degrees. A more difficult exercise would be a bridge squat where the user starts with their lower body raised from the glide board in a "bridge" position. Another exercise which can be performed on exercise device 105 is a plyometric squat exercise, performed by jumping off the foot plate 165 at the base of the unit while pushing the glide board 155 upwards, so that the user's feet leave the foot plate 165. Another exercise which can be performed on exercise device 105 are sprinters, where the user faces the glide board 155.

Additional variations involve using only one foot as well as positioning the feet in various locations and orientations on the foot plate 165.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. An inclinable exercise device for use during at least one of jumping and squat exercises, comprising:

a support;

an adjustable incline having an upper portion and a lower portion, the upper portion operably supported by the support to allow adjustment in an angle of the adjustable incline;

a user support platform movably attached to the adjustable incline for movement of the user support platform along the adjustable incline during at least one of jumping and squat exercises;

a foot support stand secured to the adjustable incline in the lower portion, the foot support engaged by one's feet during at least one of jumping and squat exercises;

one or more resistance mechanisms resisting upward movement of the user support platform along the adjustable incline during at least one of jumping and squat exercises, wherein the one or more resistance mechanisms include a variable resistance mechanism to allow adjustment in resistance in the variable resistance mechanism.

2. The inclinable exercise device of claim 1, wherein the variable resistance mechanism includes more than one elastic member selectively coupleable between the user support platform and the adjustable incline to allow adjustment in resistance in the variable resistance mechanism.

3. An inclinable exercise device for use during at least one of jumping and squat exercises, comprising:

a support;

an adjustable incline having an upper portion and a lower portion, the upper portion operably supported by the support to allow adjustment in an angle of the adjustable incline;

a user support platform movably attached to the adjustable incline for movement of the user support platform along the adjustable incline during at least one of jumping and squat exercises;

a foot support stand secured to the adjustable incline in the lower portion, the foot support engaged by one's feet during at least one of lumping and squat exercises;

one or more resistance mechanisms resisting upward movement of the user support platform along the adjustable incline during at least one of jumping and squat exercises, wherein the one or more resistance mechanisms include a braking resistance mechanism to decelerate upward motion of the user support platform along the adjustable incline.

4. The inclinable exercise device of claim 3, wherein the braking resistance mechanism is a gas strut brake.

5. An inclinable exercise device for use during at least one of jumping and squat exercises, comprising:

a support;

an adjustable incline having an upper portion and a lower portion, the upper portion operably supported by the support to allow adjustment in an angle of the adjustable incline;

a user support platform movably attached to the adjustable incline for movement of the user support platform along the adjustable incline during at least one of jumping and squat exercises;

a foot support stand secured to the adjustable incline in the lower portion, the foot support engaged by one's feet during at least one of lumping and squat exercises;

one or more resistance mechanisms resisting upward movement of the user support platform along the adjustable incline during at least one of jumping and squat exercises, wherein the adjustable incline includes a downward travel limiting mechanism that limits the maximum downward distance that the user support platform can travel.

6. The inclinable exercise device of claim 5, wherein the downward travel limiting mechanism is an adjustable knee flexion limiter and the adjustable incline includes more than one hole that the knee flexion limiter is receivable within to adjust the maximum downward distance that the user support platform can travel.

7. An inclinable exercise device for use during at least one of jumping and squat exercises, comprising:

a support;

an adjustable incline having an upper portion and a lower portion, the upper portion operably supported by the support to allow adjustment in an angle of the adjustable incline;

a user support platform movably attached to the adjustable incline for movement of the user support platform along the adjustable incline during at least one of jumping and squat exercises;

a foot support stand secured to the adjustable incline in the lower portion, the foot support engaged by one's feet during at least one of jumping and squat exercises;

one or more resistance mechanisms resisting upward movement of the user support platform along the adjustable incline during at least one of jumping and squat exercises, wherein the foot support stand includes a solid engagement surface that is continuously curved towards a user on the inclinable exercise device, keeping one's feet engaged therewith substantially perpendicular to one's lower legs during use.

8. An inclinable exercise device for use during at least one of jumping and squat exercises, comprising:

a support;

an adjustable incline having an upper portion and a lower portion, the upper portion operably supported by the support to allow adjustment in an angle of the adjustable incline;

a user support platform movably attached to the adjustable incline for movement of the user support platform along the adjustable incline during at least one of lumping and squat exercises;

a foot support stand secured to the adjustable incline in the lower portion, the foot support engaged by one's feet during at least one of jumping and squat exercises;

one or more resistance mechanisms resisting upward movement of the user support platform along the adjustable incline during at least one of jumping and squat exercises, further including a plurality of rollers that the user support platform rolls along the adjustable incline on, the rollers each including a nylon rim with a plurality of spokes surrounded by a polyurethane tire that locks around the spokes.

9. An inclinable exercise device for use during at least one of jumping and squat exercises, comprising:

a support;

an adjustable incline having an upper portion and a lower portion, the upper portion operably supported by the support to allow adjustment in an angle of the adjustable incline;

a user support platform movably attached to the adjustable incline for movement of the user support platform along the adjustable incline during at least one of jumping and squat exercises;

a foot support stand secured to the adjustable incline in the lower portion, the foot support engaged by one's feet during at least one of lumping and squat exercises;

one or more resistance mechanisms resisting upward movement of the user support platform along the adjustable incline during at least one of jumping and squat exercises, wherein the support includes a base with a suspension wheel assembly having opposing suspension wheels and respective spring assemblies urging the suspension wheels downwardly relative to the base.

10. The inclinable exercise device of claim 9, wherein the support includes a cross bar coupling the opposing suspension wheels together so as to translate force on one of the suspension wheels to the opposing suspension wheel so that the suspension wheels go up and down in unison.

11. The inclinable exercise device of claim 9, wherein the spring assemblies include spring coefficients that cause the opposing suspension wheels to retract up into the base strut when one is on the exercise device so that the exercise device and deploy downward when one is not on the exercise device.

* * * * *